US011508336B2

(12) United States Patent
Seo et al.

(10) Patent No.: US 11,508,336 B2
(45) Date of Patent: Nov. 22, 2022

(54) HEAD MOUNTED DISPLAY DEVICE AND DRIVING METHOD THEREOF

(71) Applicants: Samsung Display Co., Ltd., Yongin-Si (KR); UNIST(ULSAN NATIONAL INSTITUTE OF SCIENCE AND TECHNOLOGY), Ulsan (KR)

(72) Inventors: Young Jun Seo, Yongin-si (KR); Hyo Sun Kim, Yongin-si (KR); Young Shin Kwak, Ulsan (KR); Hye Young Ha, Ulsan (KR)

(73) Assignees: Samsung Display Co., Ltd.; Ulsan National Institute of Science and Technology

( * ) Notice: Subject to any disclaimer, the term of this patent is extended or adjusted under 35 U.S.C. 154(b) by 64 days.

(21) Appl. No.: 17/204,842

(22) Filed: Mar. 17, 2021

(65) Prior Publication Data

US 2022/0068239 A1 Mar. 3, 2022

(30) Foreign Application Priority Data

Aug. 28, 2020 (KR) ..... 10-2020-0109692

(51) Int. Cl.
*G09G 5/10* (2006.01)

(52) U.S. Cl.
CPC ..... *G09G 5/10* (2013.01); *G09G 2320/0646* (2013.01); *G09G 2320/103* (2013.01); *G09G 2360/16* (2013.01)

(58) Field of Classification Search
CPC ..... G09G 5/10; G09G 2320/0646; G09G 2320/103; G09G 2360/16; G09G 2320/0626; G02B 27/017; G02B 27/0172; G02B 2027/0118
See application file for complete search history.

(56) References Cited

U.S. PATENT DOCUMENTS

| | | | | |
|---|---|---|---|---|
| 10,380,973 | B2 * | 8/2019 | Aydin | G09G 5/02 |
| 10,621,951 | B2 | 4/2020 | Seo et al. | |
| 2019/0180716 | A1 * | 6/2019 | Seo | G02B 27/017 |
| 2020/0202814 | A1 * | 6/2020 | Chapiro | G09G 5/10 |

OTHER PUBLICATIONS

Hyeyoung HA et al., "Discomfort luminance level of head-mounted displays depending on the adapting luminance", Color Research and Application, vol. 45, Issue 4, dated Apr. 25, 2020, pp. 622-631.
Mark D. Fairchild and Garrett M. Johnson, "The iCAM Framework for Image Appearance, Image Differences, and Image Quality", Journal of Electronic Imaging 13(1), (2004), 34 pages.

* cited by examiner

*Primary Examiner* — Rodney Amadiz
(74) *Attorney, Agent, or Firm* — Innovation Counsel LLP

(57) ABSTRACT

A head mounted display device includes: a display module displaying an image; a calculator including an adaptive luminance calculator that scans a first image based on a predetermined viewing angle and calculates a first adaptive luminance of the first image, and a discomfort luminance calculator that calculates a first discomfort luminance based on the first adaptive luminance according to an equation that models a relationship between the first adaptive luminance and the first discomfort luminance at which a user perceives discomfort; and a luminance controller that controls a dimming level of the display module to be equal to or less than the first discomfort luminance.

20 Claims, 12 Drawing Sheets

HEAD MOUNTED DISPLAY DEVICE AND DRIVING METHOD THEREOF

CROSS-REFERENCE TO RELATED APPLICATION

This application claims priority under 35 U.S.C. § 119 to Korean Patent Application No. 10-2020-0109692, filed in the Korean Intellectual Property Office on Aug. 28, 2020, the disclosure of which is incorporated by reference in its entirety.

TECHNICAL FIELD

The present disclosure relates to a head mounted display device and a driving method thereof.

DISCUSSION OF THE RELATED ART

Recently, a head mounted display (HMD) has been provided as a display device that is mounted on a user's head to provide an image to the user. The head mounted display device typically has an optical unit for each of the left and right eyes of the user, and may be configured to provide a visual image combined with an audio signal. The head mounted display that is configured to provide a totally immersed experience by completely blocking the view of the real world may greatly amplify a sense of virtual reality.

A display panel including, for example, a liquid crystal element or an organic electro-luminescence element may be used as a display element of the head mounted display device. Since the head mounted display device is mounted on the user's head closely to the user's eyes, it may cause the user's discomfort such as fatigue, nausea, vomiting, and disorientation. Recently, various research has been performed to reduce the discomfort of a user using the head mounted display device.

SUMMARY

The present disclosure provides a head mounted display in which an initial image luminance is calculated in response to a surrounding illumination, and during a predetermined adaptation period, a luminance of an image is adjusted from the initial image luminance to a viewing image luminance to reduce a user's eye fatigue.

The viewing image luminance that reduces the user's eye fatigue may be adjusted in response to changes in the luminance of the image being displayed.

The present disclosure further provides a driving method of the head mounted display device that is capable of adjusting a dimming level to reduce a user's eye fatigue in response to changes in image luminance of the image being displayed.

According to an embodiment of the present disclosure, a head mounted display device includes: a display module displaying an image; a calculator including an adaptive luminance calculator that is configured to scan a first image based on a predetermined viewing angle and calculate a first adaptive luminance of the first image, and a discomfort luminance calculator that is configured to calculate a first discomfort luminance from the first adaptive luminance based on a relationship between the first adaptive luminance and the first discomfort luminance at which a user perceives discomfort; and a luminance controller that is configured to control a dimming level of the display module to be equal to or less than the first discomfort luminance.

The first adaptive luminance of the first image may be calculated through peak white with a low pass filter (LPF) based on a viewing angle of 5°. The first discomfort luminance may be calculated based on a first equation that is expressed as $Ld1=(17.2\pm0.17)*La1^{(0.417\pm0.041)}$, wherein La1 is the first adaptive luminance, Ld is the first discomfort luminance, $\alpha$ is 17.2±0.17, and $\beta$ is 0.417±0.041.

The calculator may further include a frame comparator that is configured to determine whether a second image that is different from the first image is received.

The calculator may scan the second image based on the predetermined viewing angle and calculate a second adaptive luminance of the second image.

The second adaptive luminance of the second image may be calculated through peak white with a low pass filter (LPF) based on a viewing angle of 5°.

The discomfort luminance calculator may be further configured to calculate a second discomfort luminance based on the second adaptive luminance, and the calculator may further include a discomfort luminance change determiner that is configured to determiner to change the first discomfort luminance to the second discomfort luminance according to a predetermined condition.

The predetermined condition may include that the second adaptive luminance is changed by 20% or more compared to the first adaptive luminance.

The predetermined condition may include that the second image is changed by 20% or more compared to the first adaptive luminance for 2 seconds or longer.

The second discomfort luminance may be calculated based on a second equation that is expressed as $Ld2=(17.2\pm0.17)*La2^{(0.417\pm0.041)}$, wherein La2 is the second adaptive luminance, Ld2 is the second discomfort luminance, $\alpha$ is 17.2±0.17, and $\beta$ is 0.417±0.041.

The luminance controller may adjust a dimming level of the display module to be less than or equal to the second discomfort luminance based on a change of the first discomfort luminance to the second discomfort luminance.

According to another embodiment of the present disclosure, a method for driving a head mounted display device, the method including: calculating a first adaptive luminance of a first image by scanning the first image based on a predetermined viewing angle; calculating a first discomfort luminance from the first adaptive luminance based on a relationship between the first adaptive luminance and the first discomfort luminance at which a user perceives discomfort; controlling a dimming level of the head mounted display device to be equal to or less than the first discomfort luminance.

The first adaptive luminance of the first image may be calculated through peak white with a low pass filter (LPF) based on a viewing angle of 5°.

The first discomfort luminance may be calculated based on a first equation that is expressed as $Ld1=(17.2\pm0.17)*La1^{(0.417\pm0.041)}$, wherein La1 is the first adaptive luminance, Ld is the first discomfort luminance, $\alpha$ is 17.2±0.17, and $\beta$ is 0.417±0.041.

The method may further include determining whether a second image that is different from the first image is received.

The method may further include: calculating a second adaptive luminance of the second image by scanning the second image based on the predetermined viewing angle.

The second image may be calculated through peak white with a low pass filter (LPF) based on a viewing angle of 5°.

The method may further include: changing the first discomfort luminance to a second discomfort luminance according to a change of the second adaptive luminance by 20% or more compared to the first adaptive luminance for 2 seconds or longer.

The second discomfort luminance may be calculated based on a second equation that is expressed as $Ld2=(17.2\pm0.17)*La2^{(0.417\pm0.041)}$, wherein La2 is the second adaptive luminance, Ld2 is the second discomfort luminance, $\alpha$ is 17.2±0.17, and $\beta$ is 0.417±0.041.

The method may further include: adjusting a dimming level of the second image to be less than or equal to the second discomfort luminance based on a change of the first discomfort luminance to the second discomfort luminance.

According to the head mounted display device and the driving method thereof as described with reference to the embodiments of the present disclosure, a dimming level is adjusted to reduce a user's eye strain in response to changes in luminance of an image being displayed.

However, the present disclosure is are not limited to the embodiments disclosed herein, and may be variously extended without departing from the spirit and scope of the present disclosure.

DETAILED DESCRIPTION

Figure 1:
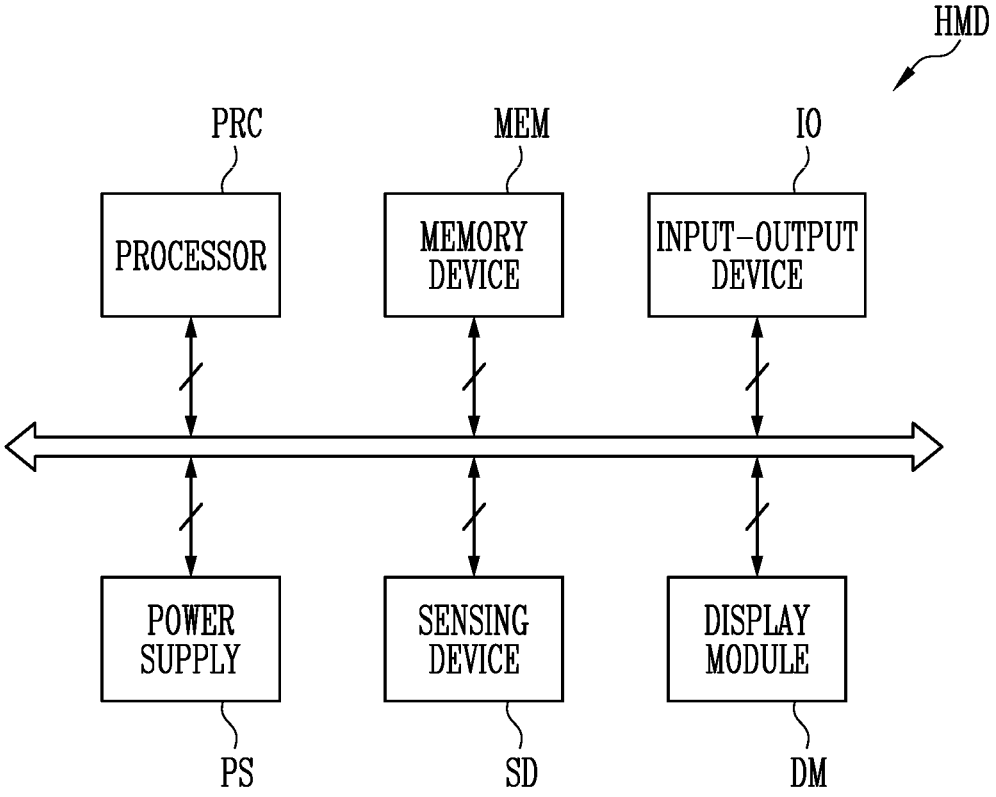
FIG. 1 illustrates a block diagram of a head mounted display device according to an embodiment of the present disclosure.

Hereinafter, embodiments of the present disclosure will be described in detail with reference to the accompanying drawings. The same reference numerals are used for the same constituent elements on the drawings, and duplicate descriptions for the same constituent elements may be omitted.

FIG. 1 illustrates a block diagram of a head mounted display device according to an embodiment of the present disclosure.

Referring to FIG. 1, a head mounted display device HMD may include a processor PRC, a memory device MEM, an input-output device IO, a power supply PS, a sensing device SD, and a display module DM. It is understood that elements/components/devices included the head mounted display device HMD are not limited to FIG. 1, and elements/components/devices illustrated in FIG. 1 may be omitted, and/or other elements/components/devices may be added without deviating from the scope of the present disclosure.

The processor PRC may perform specific calculations or tasks. The processor PRC may control the overall operation of the head mounted display device HMD. For example, the processor PRC may process signals and data through the input-output device IO, or may execute an application program stored in the memory device MEM to provide appropriate information and/or functions to a user by processing the signals and data. In an embodiment, the processor PRC may be a microprocessor, a central processing unit (CPU), a graphics processing unit (GPU), an application processor (AP), a communication processor (CP), or the like. The processor PRC may be connected to other elements/components/devices through one or more buses such as an address bus, a control bus, and a data bus. In addition, the processor PRC may be connected to an extension bus such as a peripheral component interconnect (PCI) bus.

The memory device MEM may store data for operating the head mounted display device HMD. The memory device MEM may store one or more application programs executed by the processor PRC in the head mounted display device HMD, instructions, commands, and data for operating the head mounted display device HMD. At least some of the application programs may be downloaded from an external server (not shown) through the input-output device IO. In addition, for example, the memory device MEM may include a nonvolatile memory device such as an erasable programmable read-only memory (EPROM), an electrically erasable programmable read-only memory (EEPROM), a flash memory, a phase change random access memory (PRAM), a resistance random access memory (RRAM), a magnetic random access memory (MRAM), and a ferroelectric random access memory (FRAM), and/or a volatile memory device such as a dynamic random access memory (DRAM), a static random access memory (SRAM), and a mobile DRAM.

The input-output device IO may include a camera or an image input device for inputting an image signal; a microphone or an audio input device for inputting an audio signal; a user input device (e.g., a touch key, a push key, a joystick, a wheel key) for receiving information from a user; and an output device for generating an output signal related to visual, auditory, or tactile sense, including an audio output device, a haptic device, an optical output device, etc. The display module DM may be provided in the input-output device IO.

The power supply PS may supply power for operating the head mounted display device HMD. The power supply PS may receive an external power source and supply a power (e.g., the external power received from the external power source and/or an internal power converted from the external power source) to respective elements/components/devices included in the head mounted display device HMD. The power supply PS may include a battery, for example, an embedded battery or a replaceable battery.

The sensing device SD may include at least one sensor for sensing information surrounding the head mounted display device HMD, user information, and the like. For example, the sensing device SD may include, but is not limited to, a speed sensor, an acceleration sensor, a gravity sensor, an illuminance sensor, a motion sensor, a fingerprint recognition sensor, an optical sensor, an ultrasonic wave sensor, a heat sensor, and the like.

The display module DM can be connected to other elements/components/devices through the buses and/or other communication links. The display module DM may display information processed by the head mounted display device HMD.

Figure 2:
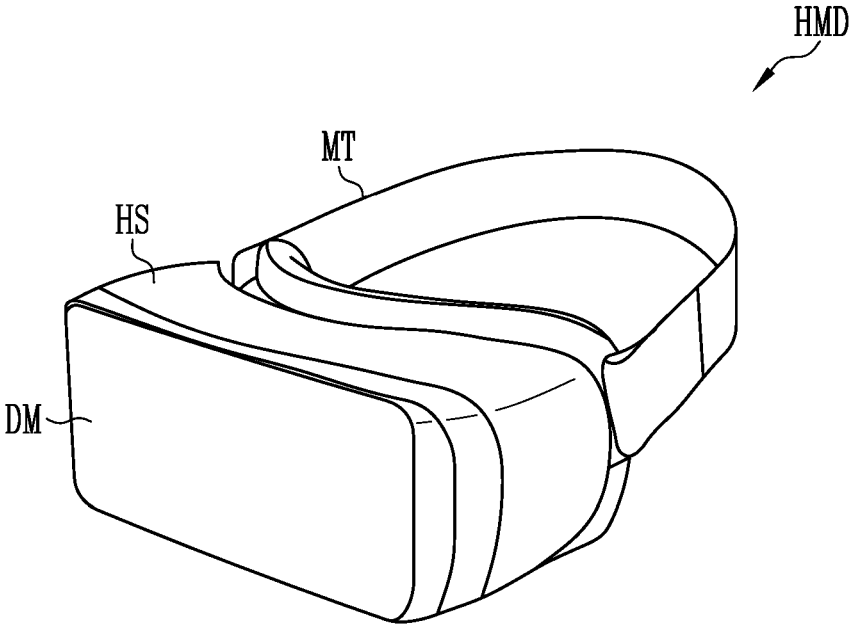
FIG. 2 illustrates a schematic view of an example in which the head mounted display device of FIG. 1 is implemented.

FIG. 2 illustrates a schematic view of an example in which the head mounted display device of FIG. 1 is implemented.

Referring to FIG. 2, the head mounted display device HMD may include the display module DM, a housing HS, and a mounting portion MT. The head mounted display device HMD may be mounted on a user's head to provide various information to the user. For example, the display module DM may provide visual information (e.g., an image) to the user based on an image signal.

In an embodiment, the display module DM may provide an image to each of the user's left eye and right eye. A left-eye image corresponding to the user's left eye and a right-eye image corresponding to the user's right eye may be the same or different from each other. The head mounted display device HMD may provide a two-dimensional (2D) image, a three-dimensional (3D) image, a virtual reality (VR) image, and/or a 360-degree panoramic image through the display module DM. Examples of the display module DM may include, but are not limited to, a liquid crystal display (LCD), an organic light emitting display (OLED), an inorganic light emitting display, and a flexible display device. The display module DM may be embedded in the housing HS, or may be coupled to or combined with the housing HS. The display module DM may receive an instruction through the housing HS.

The housing HS may be positioned in front of a user's eye. The elements/components/devices included in the head mounted display device HMD may be accommodated in the housing HS. In addition to the elements/components/devices illustrated in FIG. 1, a wireless communication unit, an interface portion, etc. may be disposed in the housing HS. The wireless communication portion may receive an image signal from an external device (not shown) by performing wireless communication with the external device. For example, the wireless communication portion may communicate with the external device using various communication protocols such as Bluetooth, radio frequency identification (RFID), infrared data association (IrDA), ZigBee, near field communication (NFC), wireless-fidelity (Wi-Fi), and ultra-wideband (UWB). The interface portion may connect the head mounted display device HMD to an external device. For example, the interface portion of the head mounted display device may include, but not limited to, a wired/wireless headset port, an external charger port, a wired/wireless data port, a memory card port, a port for connecting a device provided with an identification module, an audio input/output (I/O) port, a video I/O port, and an earphone port.

The mounting portion MT may be coupled to the housing HS so that the head mounted display device HMD may be fixed to a user's head. For example, the mounting portion MT may be implemented as a belt or an elastic band.

Figure 3:
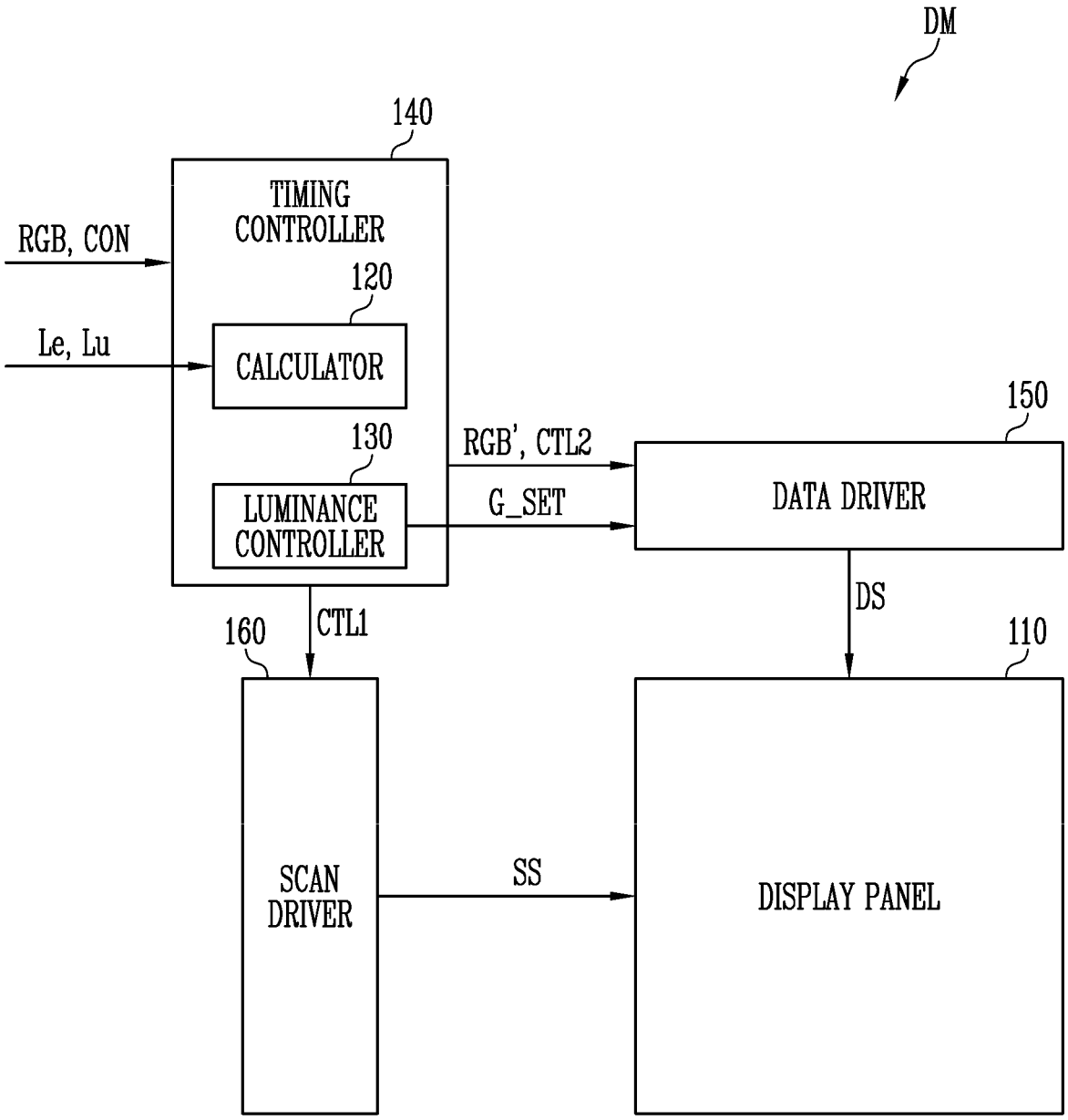
FIG. 3 illustrates a block diagram of a head mounted display device according to an embodiment of the present disclosure.
Figure 4:
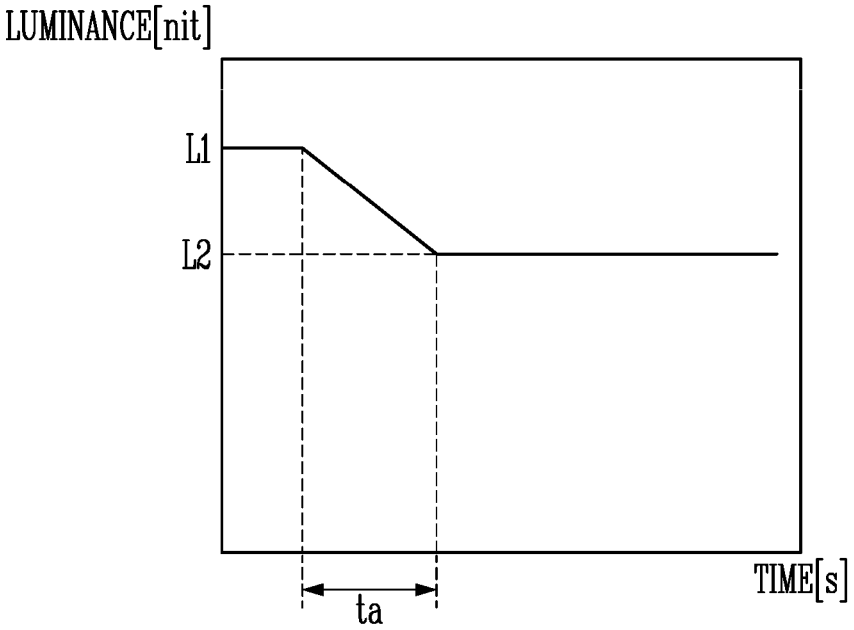
FIG. 4 is a graph for explaining initial image luminance and viewing image luminance.

FIG. 3 illustrates a block diagram of a head mounted display device according to an embodiment of the present disclosure. FIG. 4 is a graph for explaining an initial image luminance and a viewing image luminance.

Referring to FIG. 3 and FIG. 4, the display module DM of the head mounted display device HMD may include a display panel 110, a timing controller 140, a data driver 150, and a scan driver 160.

According to the embodiment, the timing controller 140 may include a calculator 120 and a luminance controller 130. However, the calculator 120 and the luminance controller 130 may be positioned within the timing controller 140, or may be connected to the timing controller 140 outside the timing controller 140.

The display panel 110 may display an image based on a data signal DS. The display panel 110 may include data lines, scan lines, and a plurality of pixels. For example, each pixel included in the display panel 110 may include a thin film transistor electrically connected to respective ones of the data lines and the scan lines, a storage capacitor connected to the thin film transistor, and a light emitting element connected to the driving transistor. The thin film transistor may include a driving transistor connected to the storage capacitor.

In order to improve display quality of the display module DM, a luminance of the display module DM may be adjusted according to a viewing environment of a user, such as illuminance of a surrounding environment. In this case, the illuminance of the surrounding environment may be sensed through an illuminance sensor included in the sensing device SD that is shown in FIG. 1.

For example, in an outdoor environment with a high surrounding illuminance, the display module DM may increase the luminance to improve visibility of an image displayed on the display panel 110, and in a dark indoor or at night, the display module DM may decrease the luminance to reduce the user's eye fatigue. Since the head mounted display device HMD is mounted on the head of the user, the user may sensitively react to glare and eye fatigue depending on a luminance of the image displayed on the display module DM.

The timing controller 140 may receive image data RGB and a control signal CON from an external device (not shown).

The timing controller 140 may selectively perform image quality correction, adaptive color correction (ACC), and/or dynamic capacitance compensation (DCC) with respect to the image data RGB supplied from the external device and output image data RGB' to the data driver 150. Alternatively, the timing controller 140 may provide the image data RGB supplied from the external device to the data driver 150 as it is. In this case, the image data RGB' is the same as the image data RGB.

The control signal CON may include a horizontal synchronization signal, a vertical synchronization signal, and a clock signal. The timing controller 140 may generate a horizontal start signal based on the horizontal synchronization signal. The timing controller 140 may generate a vertical start signal based on the vertical synchronization signal. The timing controller 140 may generate a first clock signal and a second clock signal based on the clock signal. The timing controller 140 may provide the vertical start signal and the first clock signal to the scan driver 160 as a first driving signal CTL1. The timing controller 140 may supply the horizontal start signal and the second clock signal to the data driver 150 as a second driving signal CTL2.

The calculator 120 may calculate an initial image luminance and a viewing image luminance of an image based on a relationship between an adaptive environment luminance and a determination luminance. Equation 1 provides an example of a model for determining the relationship between the adaptive environment luminance and the determination luminance. The adaptive environment luminance refers to the luminance that the user's eyes adapted to, and the determination luminance refers to the luminance in which the user does not recognize discomfort. The adaptive environment luminance and the determination luminance may be determined based on a discomfort threshold beyond which the user may feel discomfort or a limit of the adaptation to a luminance change.

$$\mathrm{Log}(Lth)=c1*\log(Lae)+c2*\log(w)+c3, \quad \text{[Equation 1]}$$

wherein, Lth is a determined luminance, Lae is an adaptive environment luminance, w is an offset, c1 is a first constant, c2 is a second constant, and c3 is a third constant.

For example, the calculator 120 may calculate an initial image luminance L1 in consideration of an ambient illuminance Le at a moment when a user wears the head mounted display device HMD using Equation 2. The luminance of the adaptive environment is not limited thereto, and the ambient illuminance Le may be replaced with a luminance Lu that may be arbitrarily set by the user. When an image having the initial image luminance L1 is displayed on the display panel 110, the user may not feel discomfort such as glare that may occur due to a sudden change in luminance.

$$\mathrm{Log}(L1)=0.904*\log(Le)+0.16*\log(w)+0.07 \quad \text{[Equation 2]}$$

In addition, the calculator 120 may calculate a viewing image luminance L2 based on the calculated initial image luminance L1 using Equation 3 below. When the viewing image luminance L2 is displayed on the display panel 110, the user may not feel fatigue even after watching an image of the head mounted display device HMD for a certain time.

$$\mathrm{Log}(L2)=0.547*\log(L1)+0.15*\log(w)+1.09 \quad \text{[Equation 3]}$$

As shown in FIG. 4, the head mounted display device HMD may first provide the initial image luminance L1 and change the initial image luminance L1 to the viewing image luminance L2 during an adaptive time ta. In one embodiment, the adaptive time ta may be within 2 minutes.

Referring back to FIG. 3, the luminance controller 130 may change the initial image luminance L1 of an image to the viewing image luminance L2 during a predetermined adaptive time (e.g., adaptive time ta). The timing controller 140 may store a plurality of gamma data sets in a lookup table (LUT). The timing controller 140 may select and output a gamma data set G_SET based on a luminance control signal outputted from the luminance controller 130. The timing controller 140 may supply the gamma data set G_SET to the data driver 150, and the data driver 150 may generate gamma voltages based on the gamma data set G_SET.

The data driver 150 may output the data signal DS in response to the second driving signal CTL2 received from the timing controller 140. For example, the data driver 150 may output a gamma voltage corresponding to an image data to a data line among the data lines as the data signal DS, in response to the horizontal start signal and the second clock signal.

The scan driver 160 may generate a scan signal SS based on the first driving signal CTL1 received from the timing controller 140. For example, the scan driver 160 may generate the scan signal SS in response to the vertical start signal and the first clock signal, and may sequentially output the scan signal SS to the scan lines.

When an image is displayed on the display panel 110 at the viewing image luminance L2, the user may not feel fatigue even after watching the image of the head mounted display device HMD for a certain time. After the user uses the head mounted display device HMD and a predetermined adaptive time elapses, the user's eyes continuously undergoes an adaptive process in response to the luminance of the image displayed on the display module DM. If the viewing image luminance L2 is not adjusted, the user may feel discomfort or eye fatigue such as glare that may occur due to a sudden change in luminance of the image.

The head mounted display device HMD according to the embodiment of the present disclosure may reduce user's eye fatigue and improve display quality by adjusting a dimming level of the display module DM in response to a change in luminance of an image. Hereinafter, the head mounted display device HMD and a driving method thereof according to an embodiment of the present disclosure will be described in detail.

Figure 5:
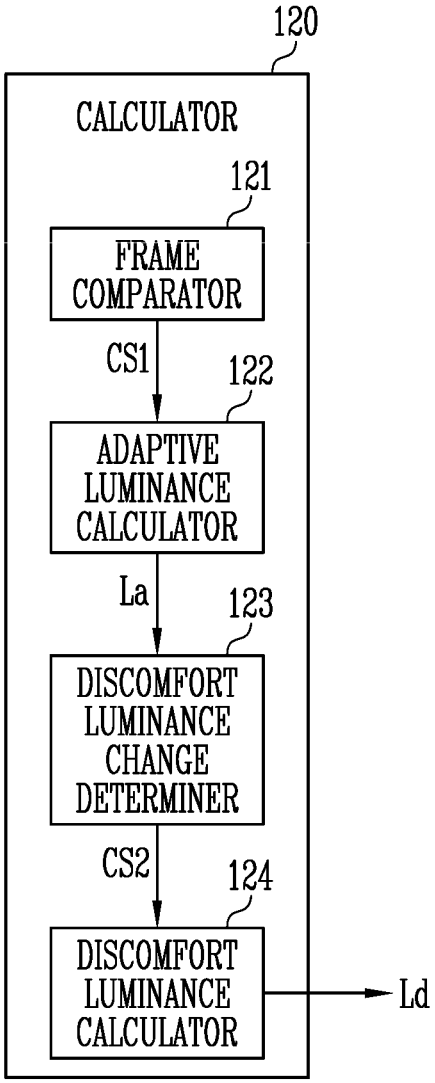
FIG. 5 schematically illustrates a block diagram of a calculator according to an embodiment of the present disclosure.

FIG. 5 schematically illustrates a block diagram of the calculator 120 of FIG. 3 according to an embodiment of the present disclosure.

Referring to FIG. 5, the calculator 120 may include a frame comparator 121, an adaptive luminance calculator 122, a discomfort luminance change determiner 123, and a discomfort luminance calculator 124.

The frame comparator 121 may determine whether a new image that is different from a previous image has been received. According to the embodiment, the frame comparator 121 may determine whether a new image is received based on a change in average luminance of an image. For example, when an image having a first luminance is displayed on the display module DM for m frames (m being an integer) and then an image having a second luminance that is different from the first luminance is received after the m frames, the frame comparator 121 may determine that a new image that is different from a previous image is received. When the frame comparator 121 determines that a new image different from a previous image is received, the frame comparator 121 may provide a first control signal CS1 to instruct the adaptative luminance calculator 122 to calculate an adaptive luminance La of the new image.

In response to the first control signal CS1 received from the frame comparator 121, the adaptive luminance calculator 122 may calculate the adaptive luminance La of the new image and provide the calculated adaptive luminance La of the new image to the discomfort luminance change determiner 123. According to the embodiment, the adaptive luminance calculator 122 may calculate the adaptive luminance La of the new image by scanning an entire area of the new image based on a predetermined viewing angle. Calculation of the adaptive luminance La will be described later in detail with reference to FIG. 6 and FIG. 7.

In response to the adaptive luminance La received from the adaptive luminance calculator 122, the discomfort luminance change determiner 123 may determine to change a discomfort luminance Ld according to a predetermined condition. The discomfort luminance Ld refers to a luminance at which a user who is adapted to the adaptive luminance La begins to perceive discomfort. According to the embodiment, when the adaptive luminance La of the new image received from the adaptive luminance calculator 122 is changed from the adaptive luminance La of the previous image by a predetermined ratio or more, and the adaptive luminance La of the new image is maintained for a predetermined time or longer, the discomfort luminance change determiner 123 may provide a second control signal CS2 to the discomfort luminance calculator 124 to instruct to change the discomfort luminance Ld.

In response to the second control signal CS2 received from the discomfort luminance change determiner 123, the discomfort luminance calculator 124 may calculate the discomfort luminance Ld for the new image.

According to the embodiment, the discomfort luminance calculator 124 may calculate the discomfort luminance Ld from the adaptive luminance La of the new image based on Equation 4 below that models a relationship between the adaptive luminance La and the discomfort luminance Ld. Calculation of the discomfort luminance Ld will be described in detail later with reference to FIG. 6 and FIG. 7.

$$Ld=\alpha*La^{\beta} \quad \text{[Equation 4]}$$

(wherein, La is the adaptive luminance, Ld is the discomfort luminance, α is a first coefficient, and β is a second coefficient.)

Figure 6:
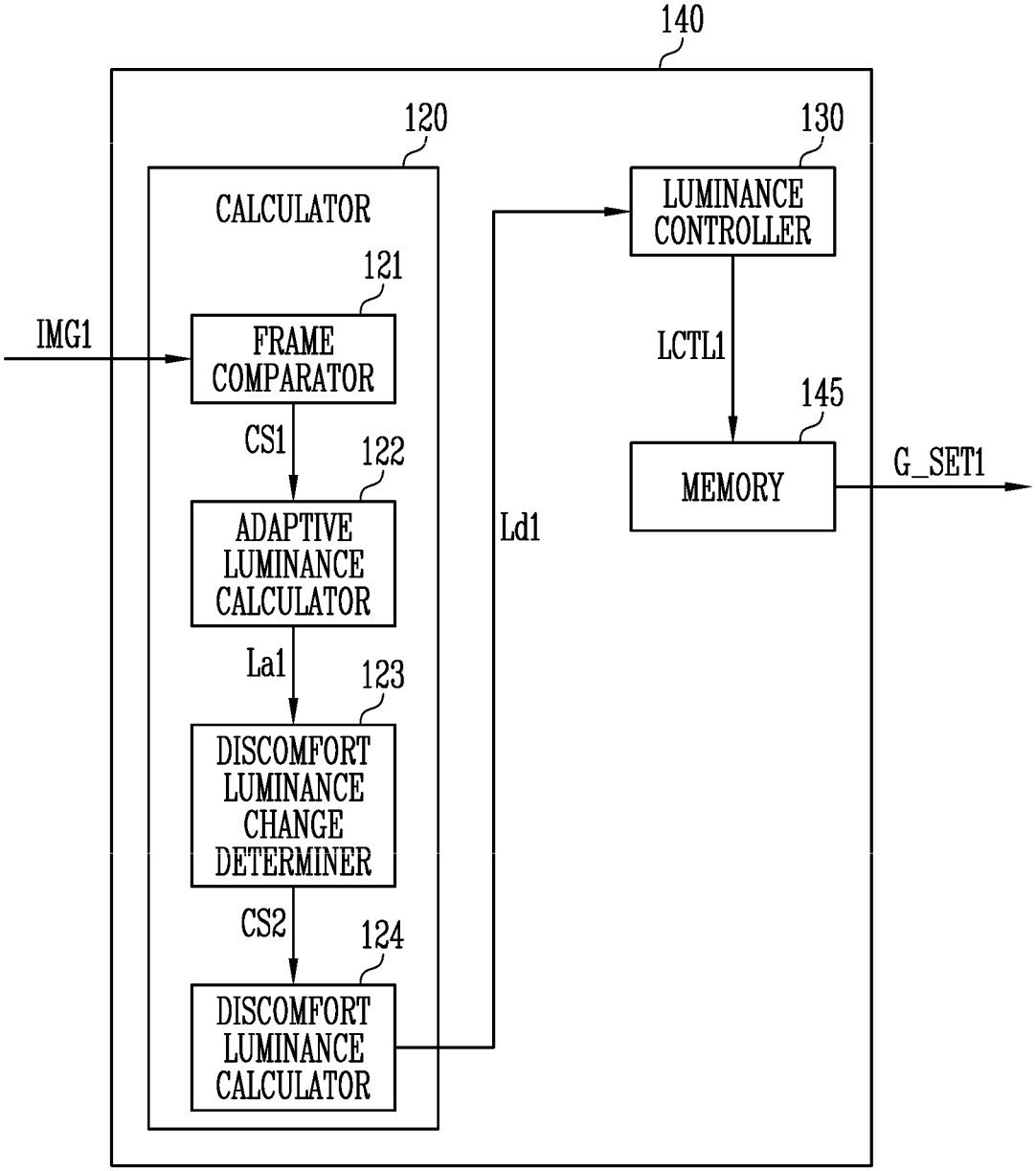
FIG. 6 and FIG. 7 illustrate block diagrams for explaining an operation of a timing controller and the calculator of FIG. 5.
Figure 7:
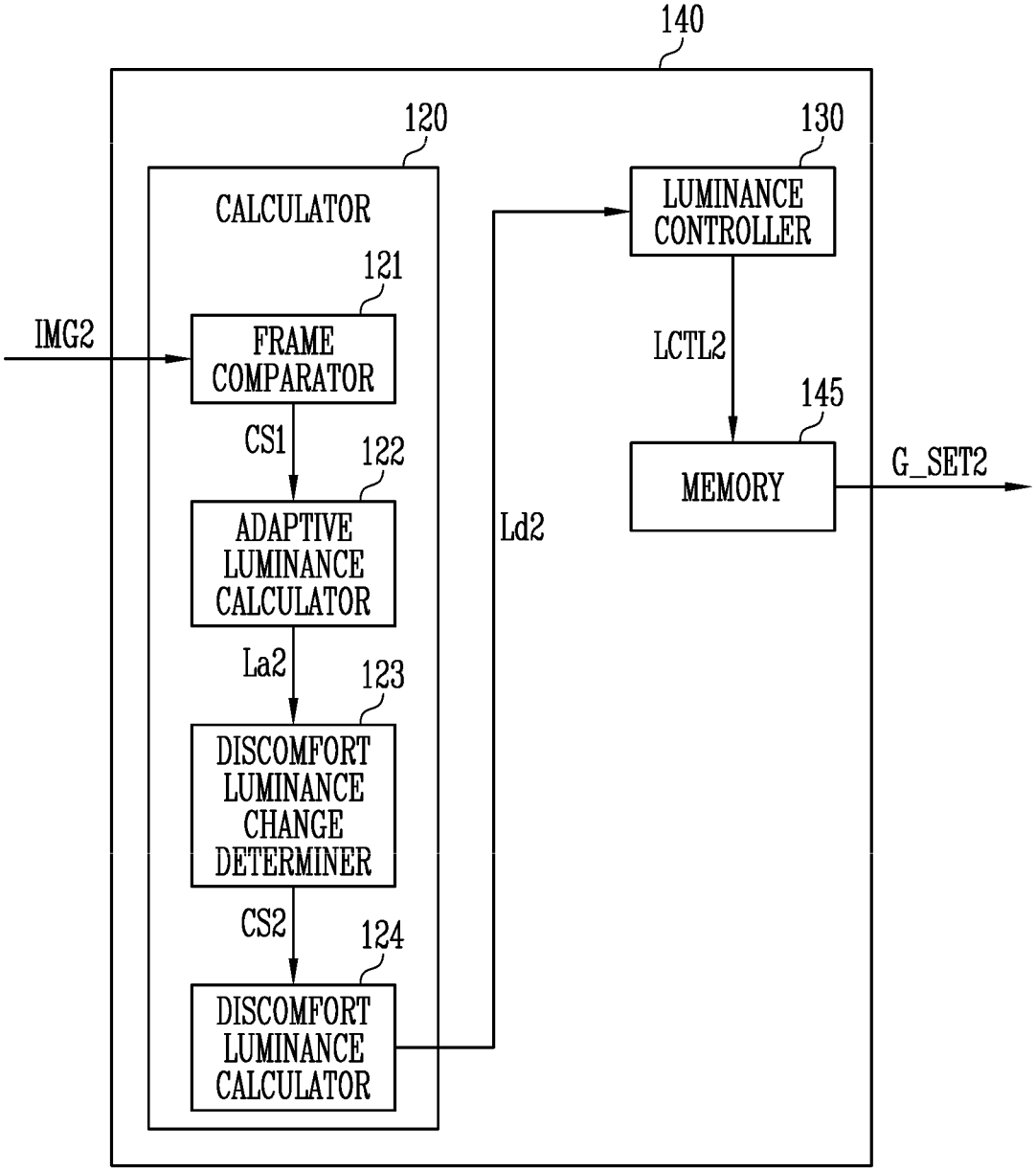

FIG. 6 and FIG. 7 illustrate block diagrams for explaining an operation of the timing controller 140 and the calculator 120 of FIG. 5. FIG. 6 illustrates a case of receiving a first image IMG1, and FIG. 7 illustrates a case of receiving a second image IMG2 that is different from the first image IMG1. The first image IMG1 may correspond to an image having the above-described viewing image luminance L2 (see FIG. 4).

Referring to FIG. 6, when the frame comparator 121 receives the first image IMG1, since there is no previous image to be compared with, the frame comparator 121 may regard the first image IMG1 as a new image. Accordingly, the frame comparator 121 determines that a new image is received, and the frame comparator 121 may provide the first control signal CS1 to the adaptive luminance calculator 122 to instruct to calculate a first adaptive luminance La1 of the first image IMG1.

In response to the first control signal CS1 received from the frame comparator 121, the adaptive luminance calculator 122 may calculate the first adaptive luminance La1 of the first image IMG1, and provide the first adaptive luminance La1 to the discomfort luminance change determiner 123.

According to the embodiment, the adaptive luminance calculator 122 may calculate the first adaptive luminance La1 of the first image IMG1 by scanning (or blurring) an entire area of the first image IMG1 based on a predetermined viewing angle. For example, the adaptive luminance calculator 122 may calculate the first adaptive luminance La1 of the first image IMG1 through peak white with a low pass filter (LPF) based on a viewing angle of 5°.

Figure 8A:
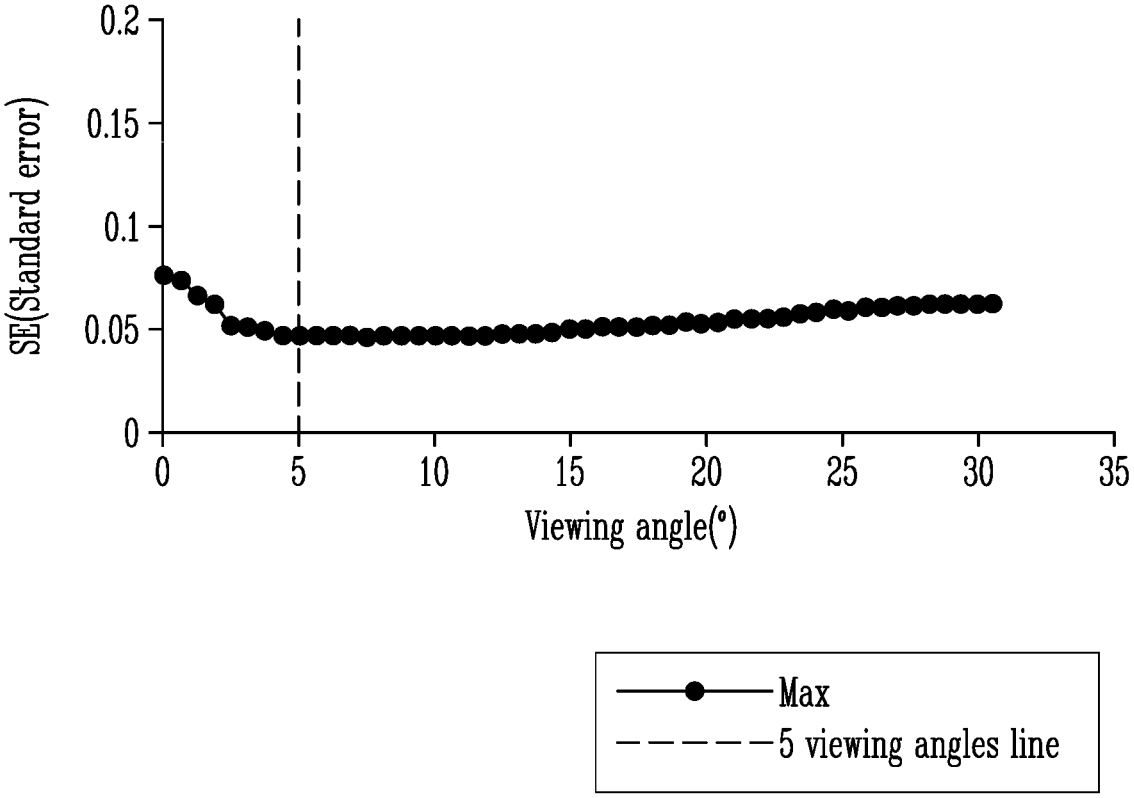
FIG. 8A illustrates a graph of a standard error according to a viewing angle.
Figure 8B:
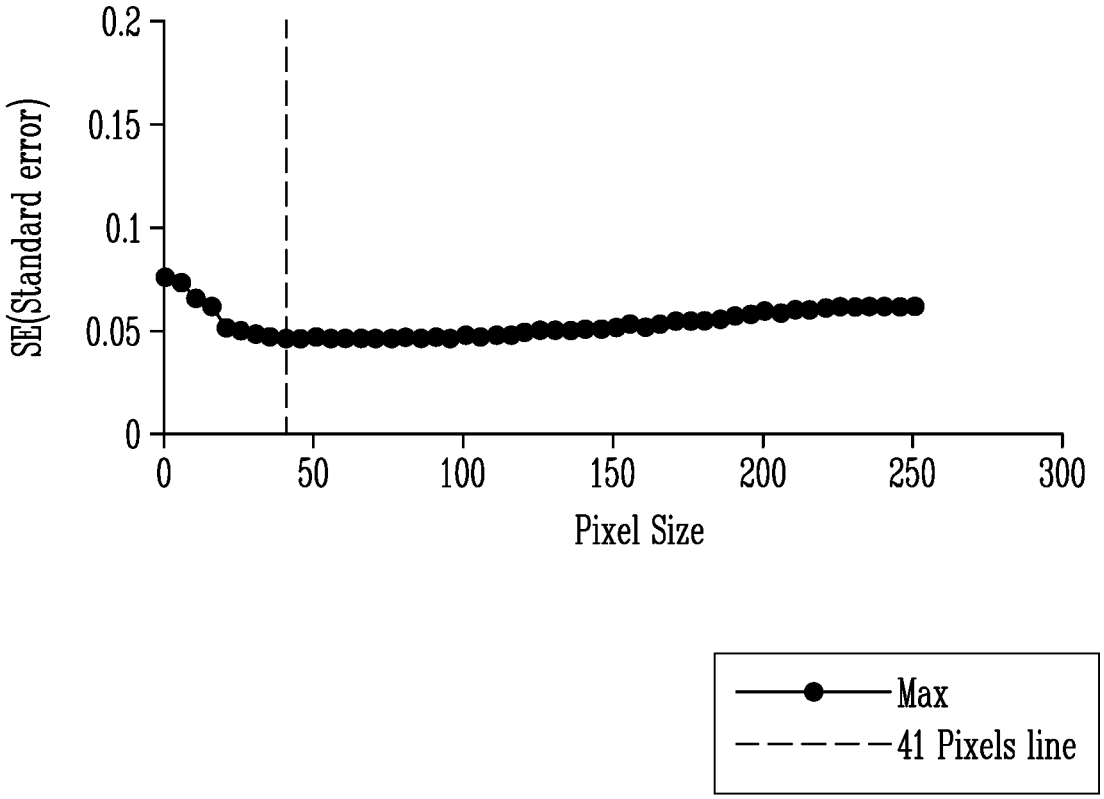
FIG. 8B illustrates a graph of a standard error according to a pixel size corresponding to the viewing angle of FIG. 8A.

FIG. 8A illustrates a graph of a standard error according to a viewing angle. FIG. 8B illustrates a graph of a standard error according to a pixel size corresponding to the viewing angle of FIG. 8A.

Referring to FIG. 8A, when the adaptive luminance (e.g., the first adaptive luminance La1 of FIG. 6) is obtained through peak white with the LPF with a viewing angle of 5° as a reference from the image (e.g., the first image IMG1 of FIG. 6), the standard error between a physical luminance level of the image and a luminance level recognized by the user may be the minimum. In contrast, when the adaptive luminance is obtained through peak white with the LPF using a viewing angle less than 5° or greater than 5° as a reference from the image, it can be seen that the standard error between the physical luminance level and the luminance level recognized by the user increases from the minimum luminance level of the viewing angle at 5°.

For example, among all the images, assuming an area corresponding to a viewing angle of 1° has a luminance of 100 cd/m$^2$, when the adaptive luminance is obtained through peak white with the LPF based on the viewing angle of 5°, the area corresponding to the viewing angle of 1° may be perceived by the user at a level of a fifth of the luminance of 100 cd/m$^2$, i.e. 20 cd/m2. That is, when the adaptive luminance of an image is obtained through peak white with the LPF, an influence of a peak in a small area that is difficult to be recognized by the user may be reduced.

Generally, a viewing angle of the head mounted display device HMD may be 110° to 120°. This is a viewing angle similar to a case in which the user is looking forward without moving their eyes from side to side. Referring to FIG. 8B, a size of an area corresponding to a viewing angle of 5° may correspond to a size of about 41 pixels in the display panel 110 of the head mounted display device HMD. That is, in a case of calculating the adaptive luminance by scanning (or blurring) an image in units of a size of 41 pixels, an effect similar to a case of calculating the adaptive luminance by scanning (or blurring) the image in units of a viewing angle of 5° may be expected.

Referring back to FIG. 6, the discomfort luminance change determiner 123 may determine to change the discomfort luminance Ld according to a predetermined condition. According to the embodiment, when the adaptive luminance La of the new image received from the adaptive luminance calculator 122 is changed from the adaptive luminance La of the previous image by a predetermined ratio or more, and the adaptive luminance La of the new image is maintained for a predetermined time or longer, the discomfort luminance change determiner 123 may provide a second control signal CS2 to the discomfort luminance calculator 124 to instruct to change the discomfort luminance Ld.

Since the first adaptive luminance La1 obtained from the first image IMG1 has no previous adaptive luminance to be compared with, it may be regarded as satisfying the predetermined condition. Accordingly, the discomfort luminance change determiner 123 may provide the second control signal CS2 to the discomfort luminance calculator 124 to instruct to calculate a first discomfort luminance Ld1 of the first image IMG1.

In response to the second control signal CS2 received from the discomfort luminance change determiner 123, the discomfort luminance calculator 124 may calculate the first discomfort luminance Ld1 for the first image IMG1.

According to an embodiment, the first coefficient (α) and the second coefficient (β) of Equation 4 may be obtained based on Equation 5 below. Equation 5 is a psychophysical logistic function. For example, based on a user's adaptation and selection of images of different complexities, the first coefficient (α) and the second coefficient (β) of Equation 4 may be obtained based on the user's reaction as a discomfort luminance level according to Equation 5. In this case, the complexity of the image may vary according to a ratio of an area having a luminance greater than an average luminance of an image.

$$FL(x;\alpha,\beta)=\frac{1}{1+\exp(-\beta(x-\alpha))} \quad \text{[Equation 5]}$$

wherein, x is an adaptive luminance for each image.

Figure 9A:
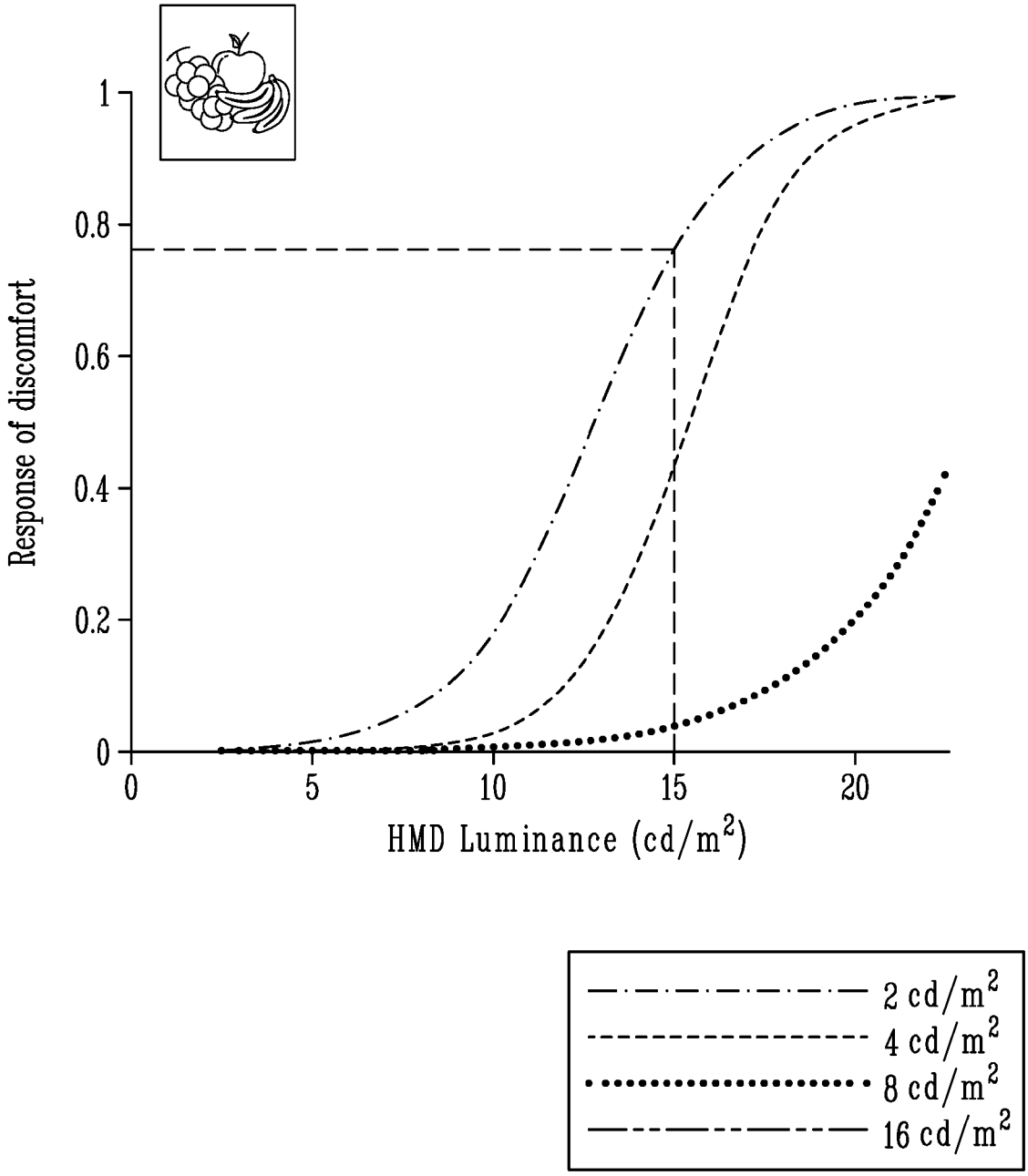
FIG. 9A and FIG. 9B are graphs of a reaction of users to images with different complexity in terms of discomfort luminance levels.
Figure 9B:
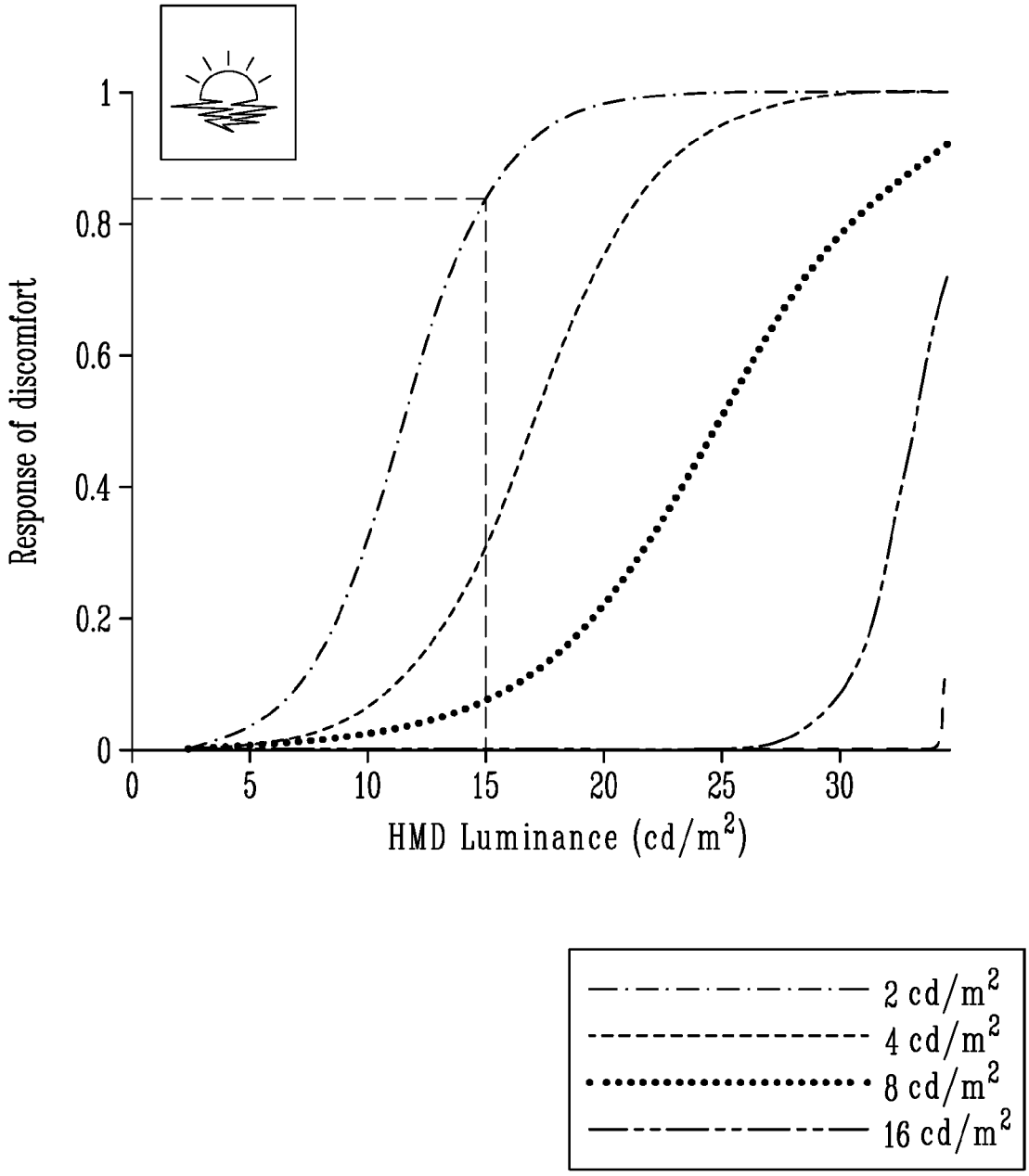

FIG. 9A and FIG. 9B are graphs of a reaction of users to images with different complexity in terms of discomfort luminance levels.

Referring to FIG. 9A and FIG. 9B, FIG. 9A shows the users' reaction to an image that displays a general object in a discomfort luminance level, and FIG. 9B shows the users' reaction to an image that displays a sunset in a discomfort luminance level.

As it can be seen in FIG. 9A and FIG. 9B, the degree to which the user senses the discomfort for images may be different based on the complexities of the images. The closer to 1 in the vertical axis (vertical axis), the higher the user's discomfort level (e.g., the user's eyes are fatigued), and the closer to 0 thereof, the lower the user's discomfort level (e.g., the user's eyes are not fatigued).

For example, in the user's reaction to the image that displays the sunset shown in FIG. 9B, assuming that the luminance of the head mounted display device HMD is the same (e.g., 25 cd/$m^2$), the user feels eye fatigue more easily when the user is adapted at 2 cd/$m^2$ than when the user is adapted at 4 cd/$m^2$ and at 8 cd/$m^2$.

In addition, assuming that the luminance of the head-mounted display device HMD is the same (e.g., 15 cd/$m^2$) and the user is adapted at the same luminance (2 cd/$m^2$), the user feels eye fatigue more easily when viewing the image that displays the sunset of FIG. 9B than when viewing the image that displays the general object of 9A.

According to an embodiment, based on a user's adaptation and selection of images of different complexities, the user's reaction may be extracted as a discomfort luminance level according to Equation 5. For example, when brightness perceived by the user and physical brightness of the image match closely, the first coefficient ($\alpha$) of Equation 4 may be set to 17.2±0.17, and the second coefficient ($\beta$) thereof may be set to 0.417±0.041. In this case, Equation 6 may be obtained as below. The discomfort luminance calculator 124 may calculate the first discomfort luminance Ld1 from the first adaptive luminance La1 of the first image IMG1 based on Equation 6.

$$Ld1=(17.2\pm0.17)*La1^{(0.417\pm0.041)} \quad \text{[Equation 6]}$$

wherein, La1 is the first adaptive luminance, and Ld1 is the first discomfort luminance.

The luminance controller 130 may generate a first luminance control signal LCTL1 corresponding to the first discomfort luminance Ld1 that is received from the discomfort luminance calculator 124, and output the first luminance control signal LCTL1 to a memory 145.

The memory 145 may store a plurality of gamma data sets. The gamma data set may be supplied to the data driver 150 to determine a gamma voltage between gamma reference voltages. As the gamma voltage is changed by the gamma data set, the luminance of the image may be changed. In this case, the memory 145 may correspond to the memory device MEM described in FIG. 1.

The timing controller 140 may output a first gamma data set G_SET1 corresponding to the first luminance control signal LCTL1 among a plurality of gamma data sets stored in the memory 145. In an embodiment, the timing controller 140 may set a dimming level of the display panel 110 equal to or less than a level of the first discomfort luminance Ld1.

Referring to FIG. 7, the frame comparator 121 receives the second image IMG2 and compares the average luminance of the first image IMG1 and the second image IMG2. When the average luminance of the first image IMG1 and the second image IMG2 are different from each other, the frame comparator 121 may determine the second image IMG2 as a new image, and provide the first control signal CS1 to the adaptive luminance calculator 122 to instruct to calculate a second adaptive luminance La2 of the image IMG2.

In response to the first control signal CS1 received from the frame comparator 121, the adaptive luminance calculator 122 may calculate the second adaptive luminance La2 of the second image IMG2, and provide the second adaptive luminance La2 to the discomfort luminance change determiner 123.

According to the embodiment, the adaptive luminance calculator 122 may calculate the second adaptive luminance La2 of the second image IMG2 by scanning (or blurring) an entire area of the second image IMG2 based on a predetermined viewing angle. For example, the adaptive luminance calculator 122 may calculate the second adaptive luminance La2 of the second image IMG2 through peak white with the LPF based on a viewing angle of 5°.

The discomfort luminance change determiner 123 may determine to change the discomfort luminance Ld according to a predetermined condition. According to the embodiment, when the second adaptive luminance La2 of the second image IMG2 that is received from the adaptive luminance calculator 122 is changed from the first adaptive luminance La1 of the first image IMG1 by a predetermined ratio or more, and the second adaptive image luminance La2 of the changed second image IMG2 is maintained for a predetermined time or longer, the discomfort luminance change determiner 123 may provide the second control signal CS2 to the discomfort luminance calculator 124 to instruct to change the current discomfort luminance Ld, in this case, the first discomfort luminance Ld1.

For example, when the second adaptive luminance La2 of the second image IMG2 is changed by 20% or more compared to the first adaptive luminance La1 of the first image IMG1, and the second adaptive image luminance La2 of the changed second image IMG2 is maintained for 2 seconds or longer, the discomfort luminance change determiner 123 may determine to change the first discomfort luminance Ld1 to the second discomfort luminance Ld2. In this case, the discomfort luminance change determiner 123 may provide the second control signal CS2 to the discomfort luminance calculator 124 to instruct to change the first discomfort luminance Ld1 to the second discomfort luminance Ld2.

In response to the second control signal CS2 received from the discomfort luminance change determiner 123, the discomfort luminance calculator 124 may calculate the second discomfort luminance Ld2 for the second image IMG2. According to an embodiment, the discomfort luminance calculator 124 may calculate the second discomfort luminance Ld2 from the second adaptive luminance La2 of the second image IMG2 based on Equation 7 below.

$$Ld2=(17.2\pm0.17)*La2^{(0.417\pm0.041)} \quad \text{[Equation 7]}$$

wherein, La2 is the second adaptive luminance, and Ld2 is the second discomfort luminance.

The luminance controller 130 may generate a second luminance control signal LCTL2 corresponding to the second discomfort luminance Ld2 that is received from the discomfort luminance calculator 124, and output the second luminance control signal LCTL2 to the memory 145.

The timing controller 140 may output a second gamma data set G_SET2 corresponding to the second luminance control signal LCTL2 among the plurality of gamma data sets stored in the memory 145. In other words, the timing controller 140 may adjust the dimming level of the display panel 110 to be equal to or less than a level of the second discomfort luminance Ld2 or less.

Figure 10:
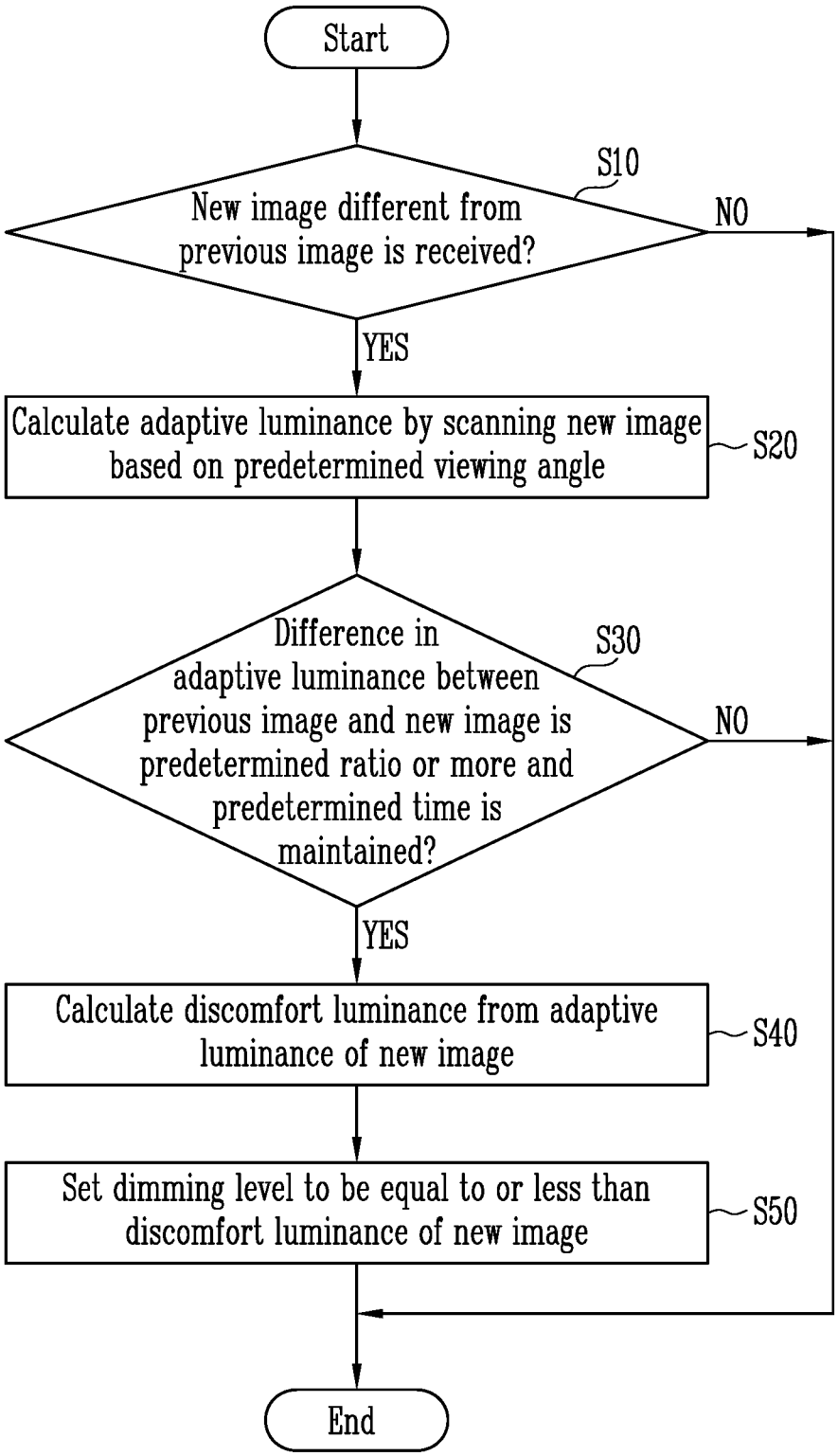
FIG. 10 is a flowchart of a driving method of a head mounted display device according to an embodiment of the present disclosure.

FIG. 10 is a flowchart of a driving method of the head mounted display device HMD according to an embodiment of the present disclosure.

Referring to FIG. 10, the driving method of the head mounted display device HMD may include: determining whether a new image that is different from a previous image is received (S10); calculating an adaptive luminance by scanning the new image based on a predetermined viewing angle (S20); determining whether a difference in the adaptive luminance between a previous image and the new image is a predetermined ratio or more and whether a predetermined time is maintained (S30); calculating a discomfort luminance from the adaptive luminance of the new image (S40); and setting a dimming level equal to or less than a discomfort luminance of the new image (S50). Hereinafter, for better understanding and ease of description, the method for calculating the first adaptive luminance La1 and the first discomfort luminance Ld1 from the first image IMG1 corresponding to the above-described viewing image luminance L2 (see FIG. 4), and the method for calculating the second adaptive luminance La2 and the second discomfort luminance Ld2 from the second image IMG2 that is different from the first image IMG1 will be separately described.

Referring to FIG. 6 and FIG. 10, the driving method of the head mounted display device HMD may include determining whether a new image (i.e., the first image IMG) that is different from a previous image is received (S10).

The frame comparator 121 may receive the first image IMG1 having the viewing image luminance L2 (see FIG. 4) and regard the first image IMG1 as the new image because there is no previous image to be compared with the first image IMG1.

Next, an adaptive luminance (i.e., the adaptive luminance La1) of the first image IMG1 may be calculated by scanning the new image, i.e., the first image IMG1, based on a predetermined viewing angle (S20).

According to an embodiment, the adaptive luminance calculator 122 may calculate the first adaptive luminance La1 of the first image IMG1 by scanning (or blurring) an entire area of the first image IMG1 based on the predetermined viewing angle. For example, the first adaptive luminance La1 of the first image IMG1 may be calculated through peak white with the LPF based on a viewing angle of 5°.

Next, it may be determined whether a difference in the adaptive luminance between the previous image and the first image IMG1 is equal to or greater than a predetermined ratio and whether a predetermined time is maintained (S30).

Since the first adaptive luminance La1 of the first image IMG1 has no previous adaptive luminance to be compared with, the discomfort luminance change determiner 123 may regard that the predetermined condition is satisfied.

Next, the first discomfort luminance Ld1 may be calculated from the first adaptive luminance La1 of the first image IMG1 (S40).

According to an embodiment, the first discomfort luminance Ld1 may be calculated based on Equation 4. The first coefficient (α) and the second coefficient (β) included in Equation 4 may be obtained through Equation 5. In one embodiment, the first coefficient (α) may be set to 17.2±0.17, and the second coefficient (β) may be set to 0.417±0.041. For example, the discomfort luminance calculator 124 may calculate the first discomfort luminance Ld1 based on Equation 6.

Next, the dimming level may be set to be less than or equal to the first discomfort luminance Ld1 of the first image IMG1 (S50).

The luminance controller 130 may output the first luminance control signal LCTL1 corresponding to the first discomfort luminance Ld1 to the memory 145. The timing controller 140 may output the first gamma data set G_SET1 corresponding to the first luminance control signal LCTL1 among the plurality of gamma data sets stored in the memory 145. In other words, the timing controller 140 may set the dimming level of the display panel 110 equal to or less than a level of the first discomfort luminance Ld1.

Referring to FIG. 7 and FIG. 10, the driving method of the head mounted display device HMD may include determining whether the second image IMG2 that is different from the first image IMG1 is received (S10).

The frame comparator 121 may receive the second image IMG2 and compare the average luminance of the first image IMG1 and the second image IMG2. When the average luminance of the first image IMG1 and the second image IMG2 are different from each other, the frame comparator 121 may determine the second image IMG2 as a new image.

Next, an adaptive luminance (i.e., the adaptive luminance La2) of the second image IMG2 may be calculated by scanning the new image, i.e. the second image IMG2, based on a predetermined viewing angle (S20).

According to an embodiment, the adaptive luminance calculator 122 may calculate the second adaptive luminance La2 of the second image IMG2 by scanning (or blurring) an entire area of the second image IMG2 based on the predetermined viewing angle. For example, the second adaptive luminance La2 of the second image IMG2 may be calculated through peak white with the LPF based on a viewing angle of 5°.

Next, it may be determined whether a difference between the first adaptive luminance La1 of the first image IMG1 and the second adaptive luminance La2 of the second image IMG2 is equal to and greater than a predetermined ratio and whether a predetermined time is maintained (S30).

According to an embodiment, when the second adaptive luminance La2 of the second image IMG2 is changed by 20% or more compared to the first adaptive luminance La1 of the first image IMG1, and the second adaptive image luminance La2 of the changed second image IMG2 is maintained for 2 seconds or longer, the discomfort luminance change determiner 123 may determine to change the first discomfort luminance Ld1 to the second discomfort luminance Ld2.

Next, the second discomfort luminance Ld2 may be calculated from the second adaptive luminance La2 of the second image IMG2 (S40).

According to an embodiment, the second discomfort luminance Ld2 may be calculated based on Equation 4. The first coefficient (α) and the second coefficient (β) included in Equation 4 may be obtained through Equation 5. In one embodiment, the first coefficient (α) may be set to 17.2±0.17, and the second coefficient (β) may be set to 0.417±0.041. For example, the discomfort luminance calculator 124 may calculate the second discomfort luminance Ld2 based on Equation 7.

Next, the dimming level may be set to be less than or equal to the second discomfort luminance Ld2 of the second image IMG2 (S50).

The luminance controller 130 may output the second luminance control signal LCTL2 corresponding to the second discomfort luminance to the memory 145. The timing controller 140 may output the second gamma data set G_SET2 corresponding to the second luminance control signal LCTL2 among the plurality of gamma data sets stored in the memory 145. In other words, the timing controller 140 may adjust the dimming level of the display panel 110 to be equal to or less than a level of the first discomfort luminance Ld2.

The driving method of the head mounted display device HMD according to the embodiments of the present disclosure may reduce user's eye fatigue and improve display quality by adjusting a dimming level of the display module DM in response to a change in luminance of an image.

While the present disclosure has been described in connection with various embodiments, it is to be understood that the present disclosure is not limited to the described embodiments, but, on the contrary, is intended to cover various modifications and equivalent arrangements included within the spirit and scope of the present disclosure including the appended claims.

What is claimed is:

1. A head mounted display device comprising:

a display module displaying an image;

a calculator including an adaptive luminance calculator that is configured to scan a first image based on a predetermined viewing angle and calculate a first adaptive luminance of the first image, and a discomfort luminance calculator that is configured to calculate a first discomfort luminance from the first adaptive luminance based on a relationship between the first adaptive luminance and the first discomfort luminance at which a user perceives discomfort; and a luminance controller that is configured to control a dimming level of the display module to be equal to or less than the first discomfort luminance.

2. The head mounted display device of claim 1, wherein the first adaptive luminance of the first image is calculated through peak white with a low pass filter (LPF) based on a viewing angle of 5°.

3. The head mounted display device of claim 2, wherein the first discomfort luminance is calculated based on a first equation that is expressed as $Ld1=\alpha*La1^{\beta}$, and wherein La1 is the first adaptive luminance, Ld is the first discomfort luminance, $\alpha$ is 17.2±0.17, and $\beta$ is 0.417±0.041.

4. The head mounted display device of claim 1, wherein the calculator further includes a frame comparator that is configured to determine whether a second image that is different from the first image is received.

5. The head mounted display device of claim 4, wherein the calculator scans the second image based on the predetermined viewing angle and calculates a second adaptive luminance of the second image.

6. The head mounted display device of claim 5, wherein the second adaptive luminance of the second image is calculated through peak white with a low pass filter (LPF) based on a viewing angle of 5°.

7. The head mounted display device of claim 5, wherein the discomfort luminance calculator is further configured to calculate a second discomfort luminance based on the second adaptive luminance, and the calculator further includes a discomfort luminance change determiner that is configured to determine to change the first discomfort luminance to the second discomfort luminance according to a predetermined condition.

8. The head mounted display device of claim 7, wherein the predetermined condition includes that the second adaptive luminance is changed by 20% or more compared to the first adaptive luminance.

9. The head mounted display device of claim 8, wherein the predetermined condition includes that the second image is changed by 20% or more compared to the first adaptive luminance for 2 seconds or longer.

10. The head mounted display device of claim 7, wherein the second discomfort luminance is calculated based on a second equation that is expressed as $Ld2=\alpha*La2^{\beta}$, and wherein La2 is the second adaptive luminance, Ld2 is the second discomfort luminance, $\alpha$ is 17.2±0.17, and $\beta$ is 0.417±0.041.

11. The head mounted display device of claim 7, wherein the luminance controller adjusts a dimming level of the display module to be less than or equal to the second discomfort luminance based on a change of the first discomfort luminance to the second discomfort luminance.

12. A method for driving a head mounted display device, the method comprising:

calculating a first adaptive luminance of a first image by scanning the first image based on a predetermined viewing angle;

calculating a first discomfort luminance from the first adaptive luminance based on a relationship between the first adaptive luminance and the first discomfort luminance at which a user perceives discomfort; and controlling a dimming level of the head mounted display device to be equal to or less than the first discomfort luminance.

13. The method of claim 12, wherein the first adaptive luminance of the first image is calculated through peak white with a low pass filter (LPF) based on a viewing angle of 5°.

14. The method of claim 13, wherein the first discomfort luminance is calculated based on a first equation that is expressed as $Ld1=\alpha*La1^{\beta}$, and wherein La1 is the first adaptive luminance, Ld is the first discomfort luminance, $\alpha$ is 17.2±0.17, and $\beta$ is 0.417±0.041.

15. The method of claim 12 further comprising:

determining whether a second image that is different from the first image is received.

16. The method of claim 15 further comprising:

calculating a second adaptive luminance of the second image by scanning the second image based on the predetermined viewing angle.

17. The method of claim 16, wherein the second adaptive luminance of the second image is calculated through peak white with a low pass filter (LPF) based on a viewing angle of 5°.

18. The method of claim 16 further comprising:

changing the first discomfort luminance to a second discomfort luminance according to a change of the second adaptive luminance by 20% or more compared to the first adaptive luminance for 2 seconds or longer.

19. The method of claim 18, wherein the second discomfort luminance is calculated based on a second equation that is expressed as $Ld2=\alpha*La2^{\beta}$, and wherein La2 is the second adaptive luminance, Ld2 is the second discomfort luminance, $\alpha$ is 17.2±0.17, and $\beta$ is 0.417±0.041.

20. The method of claim 18 further comprising:

adjusting a dimming level of the second image to be less than or equal to the second discomfort luminance based on a change of the first discomfort luminance to the second discomfort luminance.

* * * * *